US006903066B2

(12) United States Patent
Kischkel et al.

(10) Patent No.: US 6,903,066 B2
(45) Date of Patent: Jun. 7, 2005

(54) PROCESSES FOR PREPARING LIGHT-COLORED ALK(EN)YL OLIGOGLYCOSIDE MIXTURES

(75) Inventors: Ditmar Kischkel, Monheim (DE); Werner Leinemann, Ratingen (DE); Rainer Eskuchen, Langenfeld (DE); Michael Koehler, Mettmann (DE); Manfred Weuthen, Langenfeld (DE)

(73) Assignee: Cognis Deutschland GmbH & Co. KG, Duesseldorf (DE)

( * ) Notice: Subject to any disclaimer, the term of this patent is extended or adjusted under 35 U.S.C. 154(b) by 0 days.

(21) Appl. No.: 09/956,414

(22) Filed: Sep. 19, 2001

(65) Prior Publication Data

US 2002/0123453 A1 Sep. 5, 2002

(30) Foreign Application Priority Data

Sep. 19, 2000 (DE) ..... 100 46 250

(51) Int. Cl.[7] ..... C11D 3/37; C11D 3/22; C11D 3/395

(52) U.S. Cl. ..... 510/474; 510/371; 510/407; 510/413; 510/419; 510/421; 510/437; 510/470

(58) Field of Search ..... 510/371, 407, 510/413, 419, 421, 437, 470, 474

(56) References Cited

U.S. PATENT DOCUMENTS

| | | | | | |
|---|---|---|---|---|---|
| 5,362,861 | A | * | 11/1994 | McCurry et al. | 536/4.1 |
| 5,374,716 | A | | 12/1994 | Biermann et al. | 536/18.6 |
| 5,478,930 | A | * | 12/1995 | McCurry et al. | 536/18.6 |
| 5,576,425 | A | | 11/1996 | Hill et al. | 536/18.6 |
| 5,672,781 | A | | 9/1997 | Koehler et al. | 568/885 |
| 5,858,961 | A | * | 1/1999 | Weuthen | 510/535 |
| 5,866,530 | A | | 2/1999 | Schmid et al. | 510/438 |
| 2002/0058602 | A1 | * | 5/2002 | Eskuchen et al. | 510/421 |
| 2002/0123453 | A1 | * | 9/2002 | Kischkel et al. | 510/470 |

FOREIGN PATENT DOCUMENTS

| | | | | | |
|---|---|---|---|---|---|
| DE | 195 43 990 | A1 | | 5/1997 | C11D/1/825 |
| DE | 100 19 405 | A1 | | 10/2001 | C11D/17/00 |
| DE | 10046250 | | * | 3/2002 | C11D/3/22 |
| EP | 0 301 298 | A1 | | 2/1989 | C07H/15/04 |
| EP | 0 799 884 | A2 | | 10/1997 | C11D/1/825 |
| EP | 0 724 555 | B1 | | 5/1998 | C07C/29/80 |
| EP | 1188818 | | * | 3/2002 | C11D/11/00 |
| WO | WO 90/03977 | A1 | | 4/1990 | C07H/15/04 |

OTHER PUBLICATIONS

A. J. O'Lenick, Jr., et al., "Amphoteric Surfactants, A Review of the Chemistry and Applications", HAPPI, (Nov., 1986), pp. 70, 72, 74, 125–126.

K. Hill, et al., "Alkyl Polyglycosides, Technology, Properties and Applications", VCH–Verlagsgesellschaft mbH, Weinheim, (1997) (not enclosed—reciting entire book), no month given.

* cited by examiner

*Primary Examiner*—Brian P. Mruk
(74) *Attorney, Agent, or Firm*—Aaron R. Ettelman

(57) ABSTRACT

Processes for preparing light-colored alkyl and/or alkenyl oligoglycoside mixtures are disclosed. The processes disclosed include providing an initial mixture of an alk(en)yl oligoglycoside and a rheology-modifying agent, the mixture having a viscosity of from 10 to 1000 mPas at a temperature of from 85 to 130° C., and a water content of less than 2% by weight, based on the alk(en)yl oligoglycoside; and bleaching the initial mixture at a temperature of from 85 to 130° C. to form a light-colored surfactant mixture having a water content of less than 2% by weight, based on the alk(en)yl oligoglycoside. Also disclosed is the use of such mixtures in cleaning compositions, such as detergents, washing and dishwashing compositions.

16 Claims, No Drawings

PROCESSES FOR PREPARING LIGHT-COLORED ALK(EN)YL OLIGOGLYCOSIDE MIXTURES

BACKGROUND OF THE INVENTION

Alkyl oligoglycosides are important surfactants since, being nonionic compounds, they are compatible with a large number of other ingredients, but exhibit a foaming and cleaning ability which is very much closer to that of anionic surfactants. Because of their good degradability and skin compatibility, they are used in cosmetics and in washing, dishwashing and cleaning compositions.

The starting materials used for their preparation are a glycose and branched, unbranched, and saturated and unsaturated alcohols, which are acetylated in the presence of acidic catalysts. To shift the reaction equilibrium, the alcohol is usually used in considerable excess. This results in reaction mixtures containing 20 to 50% alkyl and/or alkenyl oligoglycosides and 50 to 80% alcohol, which means that the resulting glycosides then have to be freed from unreacted alcohol at great technical expenditure before they can then be made into a paste with water and bleached.

Bleaching of the alkyl and/or alkenyl oligoglycoside is generally necessary since dark decomposition products form while the alcohol is being distilled off. Hitherto, the bleaching operation has only been possible with great technical expenditure.

European application EP 0 799 884 A2 (Unilever) describes liquid surfactant mixtures of alkyl and/or alkenyl oligoglycosides and ethoxylated nonionic surfactants in the weight ratio 35:65 and 65:35 and 2 to 25% water, and a process for the preparation of the surfactant mixtures. In the process, the bleaching agent used is a 30% strength aqueous hydrogen peroxide solution at temperatures of from 80 to 100° C. The content of water prior to bleaching should not be greater than 8% since more water is introduced as a result of the bleaching step. In the course of this process, water has to be added during the bleaching operation and accordingly be removed again. The surfactant mixtures of alkyl and/or alkenyl oligoglycosides and ethoxylated nonionic surfactants comprise at least 3.8% water. In contrast, the surfactant mixtures according to the invention are virtually anhydrous, i.e. are prepared with water contents of less than 2% by weight.

German patent specification DE 19543990 (Henkel) discloses liquid, anhydrous precursors for the preparation of washing, dishwashing and cleaning compositions which consist of alkyl and/or alkenyl oligoglycosides and alkyl polyglycol ethers in the weight ratio 10:90 and 90:10. Mixtures flowable at 40° C. which can be used in granulation processes for the preparation of laundry detergents are described.

German application DE 10019405 (Cognis), unpublished at the priority date of the present invention, describes anhydrous laundry detergent granules which comprise technical-grade mixtures of alkyl and/or alkenyl oligoglycosides and at most 30% by weight of fatty alcohol. These surfactant mixtures can be mixed or extruded together with laundry detergent additives.

The present invention is based on the object of developing a process for the preparation of light-colored alkyl and/or alkenyl oligoglycoside mixtures which avoids said disadvantages, in particular to prepare alkyl and/or alkenyl oligoglycoside mixtures with a low water content.

This is achieved by the content according to the invention of rheology-modifying agents, in particular by alcohol. This results in favorable rheology properties of the surfactant mixtures and these are thus accessible to a direct bleaching, without great technical expenditure, i.e. no aqueous alkyl and/or alkenyl oligoglycoside pastes have to be prepared by adding water for the bleaching. Using the process according to the invention, it is possible to prepare light-colored, high-concentration alkyl and/or alkenyl oligoglycoside-containing surfactant mixtures which are economically favorable both as a result of their preparation process and also with regard to transportation, thus saving energy and costs.

SUMMARY OF THE INVENTION

The invention relates to a process for the preparation of light-colored alkyl and/or alkenyl oligoglycoside mixtures and to the use thereof in washing, dishwashing and cleaning compositions.

The invention provides a process for the preparation of light-colored surfactant mixtures, where the mixtures comprise at least alkyl and/or alkenyl oligoglycosides, rheology-modifying agents and less than 2% by weight of water. Preference is given here to those mixtures which are adjusted to viscosities of from 10 to 1000 mPas, preferably 50 to 500 mPas, at temperatures of from 85 to 130° C., in particular at 90 to 120° C., and are then bleached.

The preparation of the mixture is possible without the addition of water, i.e. no water is added in order to obtain bleachable, pumpable and easy-to-process mixtures with favorable rheology properties. Particular preference is given to mixtures which comprise less than 2% by weight, preferably at most 1.5% by weight, in particular at most 0.5% by weight, of water, based on the alkyl and/or alkenyl oligoglycoside active substance. This water is introduced primarily via the bleaches and agents for adjusting the pH used.

The invention incorporates the knowledge that the content of alcohol according to the invention improves the rheological properties of the alkyl and/or alkenyl oligoglycosides. Without wishing to be bound by any one theory, only the fatty alcohol content according to the invention permits the bleaching process.

The term "light-colored" is to be understood as meaning color numbers according to Klett of <60, preferably <40, in particular <30, measured in a 1% strength solution of the mixture according to the invention in isopropyl alcohol.

In a further embodiment, a process for the preparation of light-colored surfactant mixtures is preferred which is characterized in that the mixtures resulting therefrom comprise at most 1.5% by weight of water.

Alkyl and/or Alkenyl Oligoglycosides

To prepare the mixtures according to the invention, alkyl and/or alkenyl oligoglycosides are used which conform to the formula (I)

$$R^1O\text{-}[G]_p \qquad (I)$$

in which $R^1$ is a branched and unbranched alkyl and/or alkenyl radical having 4 to 22 carbon atoms, G is a sugar radical having 5 or 6 carbon atoms and p is a number from 1 to 10. They are preferably prepared by reacting glucose or dextrose monohydrate and fatty alcohol in the presence of catalysts.

Here, they can be obtained by relevant methods of preparative organic chemistry. As representatives of the extensive literature, reference may be made here to the specifications EP A1 0301298, WO 90/03977 and to "Alkyl Polyglycosides, Technology, Properties and Applications" (K. Hill, VCH 1997).

The alkyl and/or alkenyl oligoglycosides can be derived from aldoses or ketoses having 5 or 6 carbon atoms, preferably glucose. The preferred alkyl and/or alkenyl oligoglycosides are thus alkyl and/or alkenyl oligoglucosides. The index p in the general formula (I) gives the degree of oligomerization (DP), i.e. the distribution of mono- and oligoglycosides, and is a number between 1 and 10. While p in a given compound must always be a whole number and here can primarily assume the values p=1 to 6, the value p for a certain alkyl oligoglycoside is an analytically determined calculated parameter which in most cases is a fraction. Preference is given to using alkyl and/or alkenyl oligoglycosides with an average degree of oligomerization p of from 1.1 to 3.0. From a performance viewpoint, preference is given to those alkyl and/or alkenyl oligoglycosides whose degree of oligomerization is less than 1.7 and in particular between 1.2 and 1.4.

The alkyl or alkenyl radical $R^1$ can be derived from primary alcohols having 4 to 11, preferably 8 to 10, carbon atoms. Typical examples are butanol, caproic alcohol, caprylic alcohol, capric alcohol and undecyl alcohol, and technical-grade mixtures thereof, as are obtained, for example, during the hydrogenation of technical-grade fatty acid methyl esters or in the course of the hydrogenation of aldehydes from the Roelen oxo synthesis. Preference is given to alkyl oligoglucosides of chain length $C_8$–$C_{10}$ (DP=1 to 3) which are produced as forerunnings during the distillative separation of technical-grade $C_8$–$C_{18}$-coconut fatty alcohol and can be contaminated with a proportion of less than 6% by weight of $C_{12}$-alcohol, and alkyl oligoglucosides based on technical-grade $C_9$–$C_{11}$-oxo alcohols (DP=1 to 3), or mixtures thereof. The alkyl or alkenyl radical $R^1$ may also be derived from primary alcohols having 12 to 22, preferably 12 to 18, carbon atoms, and from $C_{12-15}$-oxo alcohols or mixtures thereof. Typical examples are lauryl alcohol, myristyl alcohol, cetyl alcohol, palmoleyl alcohol, stearyl alcohol, isostearyl alcohol, oleyl alcohol, elaidyl alcohol, petroselinyl alcohol, arachydyl alcohol, gadoleyl alcohol, behenyl alcohol, erucyl alcohol, brassidyl alcohol, and technical-grade mixtures thereof which can be obtained as described above. Preference is given to alkyl oligoglucosides based on hydrogenated $C_{12/14}$-coconut alcohol with a DP of from 1 to 3.

To prepare the surfactant mixtures according to the invention it is possible to use aliphatic, branched and unbranched, saturated and unsaturated alcohols having a carbon chain length of from 2 to 31, or mixtures thereof. Particular preference is given to branched alcohols having 11 to 22 carbon atoms and a low boiling and solidification point.

Preference is given to fatty alcohols of the formula $R^2OH$ (II), where $R^1$ can be equated with $R^2$. These fatty alcohols are useful as rheology-modifying agents in the alkyl and/or alkenyl oligoglycoside mixture.

In a further preferred embodiment, a process for the preparation of the light-colored surfactant mixtures according to the invention is preferred in which 6 to 30% by weight, preferably 8 to 25% by weight and in particular 10 to 15% by weight, of a rheology-modifying agent are present. The data for the weight ratio are based on the active substance content of alkyl and/or alkenyl oligoglycoside.

For the purposes of the process according to the invention, preference is given to preparing technical-grade synthesis mixtures comprising alkyl and/or alkenyl oligoglycosides which, as a result of the way in which the reaction is carried out, still comprise free alcohol, preferably fatty alcohols of the formula (II) of from 6 to 30% by weight, preferably 8 to 25% by weight, in particular 10 to 15% by weight, based on the active substance alkyl and/or alkenyl oligoglycosides. However, it is also possible to prepare the surfactant mixtures according to the invention by mixing alkyl and/or alkenyl oligoglycosides with alcohols, preferably fatty alcohols of the formula (II).

The surfactant mixtures according to the invention can also be prepared by mixing with an alcohol other than that used for the synthesis. Preference is given to using this process if the synthesis alcohol has an inherent intensive odor. In this case, the synthesis alcohol is removed by distillation and replaced by a low-odor alcohol.

The rheology-modifying agents used are compounds chosen from the group formed from alcohols, alkoxylated alkanols and alkylene oxides.

Alcohols

Saturated and unsaturated, linear and branched alcohols are used for reducing the viscosity. Preferably, primary, secondary and tertiary, but also monohydric and dihydric alcohols can be used. Examples thereof are ethanol, n-butanol, isopropanol and glycols based on ethylene, propylene and butylene. Particular preference is given to the use of ethanol and propylene glycol.

Also preferred are fatty alcohols of the formula (II) which are either already present in the alkyl and/or alkenyl oligoglycoside mixture as a consequence of the process (see depletion), or are added subsequently to the alkyl and/or alkenyl oligoglycosides.

Fatty Alcohols

Fatty alcohols of the formula (II) are preferably used as rheology-modifying agent. Fatty alcohols are to be understood as meaning primary alcohols of the formula (II), $$R^2OH \qquad \text{(II)}$$

in which $R^2$ is an aliphatic, linear or branched hydrocarbon radical having 4 to 22 carbon atoms and 0 and/or 1, 2 or 3 double bonds. Typical examples are caproic alcohol, caprylic alcohol, 2-ethylhexyl alcohol, capric alcohol, lauryl alcohol, isotridecyl alcohol, myristyl alcohol, cetyl alcohol, palmoleyl alcohol, stearyl alcohol, isostearyl alcohol, oleyl alcohol, elaidyl alcohol, petroselinyl alcohol, linolyl alcohol, linolenyl alcohol, elaeostearyl alcohol, arachydyl alcohol, gadoleyl alcohol, behenyl alcohol, erucyl alcohol and brassidyl alcohol, and technical-grade mixtures thereof which are produced, for example, during the high-pressure hydrogenation of technical-grade methyl esters based on fats and oils or aldehydes from the Roelen oxo process, and as monomer fraction during the dimerization of unsaturated fatty alcohols. Preference is given to technical-grade fatty alcohols having 12 to 18 carbon atoms, such as, for example, coconut, palm, palm kernel or tallow fatty alcohol. Particular preference is given to linear fatty alcohols having 12 to 16 carbon atoms, in particular having 12 to 14 carbon atoms.

The alkenyl radical $R^2$ can be derived from primary unsaturated alcohols. Typical examples of saturated alcohols are undecan-1-ol, lauroleyl alcohol, myristoleyl alcohol, palmitoleyl alcohol, petroseladyl alcohol, oleyl alcohol, elaidyl alcohol, ricinoleic alcohol, linoleyl alcohol, linolenyl alcohol, gadoleyl alcohol, arachidonyl alcohol, erucyl alcohol, brassidyl alcohol, palmoleyl alcohol, petroselinyl alcohol, arachyl alcohol, and mixtures thereof and mixtures of unsaturated and saturated fatty alcohols which have been obtained by the processes described in EP 0724 555 B1.

Preference is also given to plant-based saturated and unsaturated fatty alcohols which are essentially, i.e. at least to 10% by weight, unsaturated, and have iodine numbers of from 20 to 130, preferably 20 to 110, in particular 20 to 85 and a conjugated ene content of less than 4.5% by weight, preferably 6% by weight.

Guerbet Alcohols

Also preferred are Guerbet alcohols which are branched in the 2-position with an alkyl group and are usually prepared by base-catalyzed condensation of fatty alcohols. An overview of this topic is given by A. J. O'Lennick and R. E. Bilbo in Soap Cosm. Chem. Spec. April, 52 (1987). Preferred Guerbet alcohols are derived from fatty alcohols having 6 to 22 carbon atoms, such as, for example, 2-ethylhexanol, 2-butyloctanol, 2-hexyldecanol and/or 2-octyldodecanol. Particular preference is given to Guerbet alcohols which are prepared on the basis of $C_6$–$C_{12}$-fatty alcohol mixtures, comprising caproic alcohol, caprylic alcohol, 2-ethylhexanol, capric alcohol and/or lauryl alcohol. A typical fatty alcohol section, which is suitable as starting material for the preferred Guerbet alcohols, contains less than 5% by weight of $C_6$, 50 to 60% by weight of $C_8$, 35 to 45% by weight of $C_{10}$ and less than 2% by weight of $C_{12}$. Guerbet alcohols of this type are described in more detail in German patent specification DE 4351794 C1 (Henkel), the teaching of which is expressly incorporated by reference.

Oxo Alcohols

Also preferred are branched fatty alcohols, the so-called oxo alcohols, having 4 to 20 carbon atoms which carry in most cases 1 to 4 methyl or ethyl groups as branches and are prepared by the oxo process.

Depletion

Low fatty alcohol contents in the alkyl and/or alkenyl oligoglycoside mixtures have hitherto been desirable. In order to achieve this, evaporation has to be carried out with a high input of energy, which is to be regarded as negative for the process for cost reasons. Furthermore, it must be taken into consideration that the glycosides are temperature-sensitive, and therefore a gentle and thus technically complex separation would be necessary. Higher fatty alcohol contents thus have a cost advantage.

Depletion to the content of alcohols according to the invention is to be carried out from a technical viewpoint with consideration of the known low thermal stability of sugar surfactants (risk of caramelization). For this, all evaporator types are suitable which take into account this circumstance, but preferably thin-layer evaporators, falling-film evaporators or short-path evaporators, and, if necessary, any combinations of these components. The depletion can be carried out in a manner known per se, for example at temperatures in the range from 110 to 220° C. and at reduced pressures of from 0.1 to 10 mbar.

In a preferred embodiment, the surfactant mixtures according to the invention are admixed with alkoxylated alkanols.

Alkoxylated Alkanols

Preference is given to using alkoxylated alkanols of the formula (III) as rheology-modifying agents. Typical examples thereof are fatty alcohol polyethylene glycol/polypropylene glycol ethers of the formula (III) and fatty alcohol polypropylene glycol/polyethylene glycol ethers of the formula (IV).

Fatty Alcohol Polyethylene Glycol/Polypropylene Glycol Ethers

In a preferred embodiment, fatty alcohol polyethylene glycol/polypropylene glycol ethers of the formula (III), which are optionally terminally capped, $$R^3O(CH_2CH_2O)_n[CH_2(CH_3)CHO]_mR^4 \quad \text{(III)}$$

in which $R^3$ is an alkyl and/or alkenyl radical having 8 to 22 carbon atoms, $R^4$ is H or an alkyl radical having 1 to 8 carbon atoms, n is a number from 1 to 40, preferably 1 to 30, in particular from 1 to 15, and m is 0 or a number from 1 to 10, are used as rheology-modifying agent.

Fatty Alcohol Polypropylene Glycol/Polyethylene Glycol Ethers

It is also preferred to use fatty alcohol polypropylene glycol/polyethylene glycol ethers of the formula (IV), which are optionally terminally capped, $$R^5O[CH_2(CH_3)CHO]_q(CH_2CH_2O)_rR^6 \quad \text{(IV)}$$

in which $R^5$ is an alkyl and/or alkenyl radical having 8 to 22 carbon atoms, $R^6$ is H or an alkyl radical having 1 to 8 carbon atoms, q is a number from 1 to 5 and r is a number from 0 to 15, as rheology-modifying agent.

In the process according to the invention, a preferred embodiment corresponds to fatty alcohol polyethylene glycol/polypropylene glycol ethers of the formula (III) in which $R^3$ is an aliphatic, saturated, straight-chain or branched alkyl radical having 8 to 16 carbon atoms, n is a number from 1 to 10, and m is 0 and $R^4$ is hydrogen. These are addition products of from 1 to 10 mol of ethylene oxide onto monofunctional alcohols. Suitable alcohols are the alcohols described above, such as fatty alcohols, oxo alcohols and Guerbet alcohols.

Also suitable among such alcohol ethoxylates are those which have a narrowed homologue distribution.

Further suitable representatives of terminally uncapped representatives are those of the formula (III) in which $R^3$ is an aliphatic, saturated, straight-chain or branched alkyl radical having 8 to 16 carbon atoms, n is a number from 2 to 7, m is a number from 3 to 7 and $R^4$ is hydrogen. These are addition products of monofunctional alcohols of the type already described alkoxylated firstly with 2 to 7 mol of ethylene oxide and then with 3 to 7 mol of propylene oxide.

Alkylene Oxides

Also preferred for use as rheology-modifying agents are alkylene oxides. Preference is given to polyglycol ethers and polyglycols based on ethylene, propylene and butylene. Particular preference is given to 1,2-propylene glycol and 1,3-propanediol, and to ethyl and butyl ethers thereof.

Bleaches

In a further embodiment, bleaches, preferably hydrogen peroxide, in particular in the form of a 30 to 35% strength aqueous solution, are used in the process according to the invention. Also preferred is the bleaching with organic peracids, such as, for example, dodecanediperacid. The bleaching can also be carried out using chlorine bleach liquor.

pH

In a further embodiment, the pH is adjusted during the bleaching operation preferably to values between 6 and 12, in particular 7 to 10, by adding alkali, preferably sodium hydroxide solution. To indirectly determine the pH, a sample is taken. The pH is then determined in a 20% strength solution of the surfactant mixture according to the invention in 15% strength isopropanol.

The invention further provides compositions comprising alkyl and/or alkenyl oligoglycosides, rheology-modifying agents and at most 1.5% by weight, preferably 1.0% by weight and in particular 0.5% by weight, of water. In a further embodiment, it is preferred that the compositions comprise 6 to 30% by weight of alcohols, advantageously preferably fatty alcohol (based on alkyl and/or alkenyl oligoglycoside active substance). The compositions according to the invention may advantageously comprise bleaches which can either be added as the result of the nature of the process or separately.

In addition, preference is given to compositions which have viscosities of from 10 to 1000 mPas at temperatures of from 85 to 130, preferably 90 to 120° C.

The application also provides mixtures which comprise 6 to 30% by weight, preferably 8 to 25% by weight, in particular 10 to 15% by weight, of fatty alcohol (based on alkyl and/or alkenyl oligoglycoside active substance), have a viscosity of from 10 to 1000 mPas, preferably 50 to 500 mPas and a color number of <60, preferably <40, in particular <30 according to Klett, measured in a 1% strength solution of the mixture according to the invention in isopropyl alcohol.

INDUSTRIAL APPLICABILITY

The process according to the invention gives high-concentration, anhydrous, light-colored alkyl and/or alkenyl oligoglycoside mixtures which can be incorporated without problems and in a cost-effective manner preferably in washing, dishwashing and cleaning compositions, for example by application to a solid laundry detergent ingredient. This can be carried out by spray drying, or else in a mixer or a fluidized bed, drying and granulation being carried out simultaneously. Express reference is made in this connection to German application DE 10019405, unpublished at the priority date of the present invention, the teaching of which, in particular that of pages 5 to 22, is to be incorporated herein.

The application further provides for the use of the surfactant mixtures according to the invention in washing, dishwashing and cleaning compositions and formatting compositions. Preference is given to formulating liquid and gel-like washing, dishwashing and cleaning compositions. As a result of the work-up, the surfactant mixtures may also comprise bleaches which then represent a stable bleaching system in anhydrous formulations which develops its bleaching action during the subsequent washing or cleaning operation. However, it is of course possible to prepare bleach-free surfactant mixtures using the process according to the invention.

In addition, a great advantage of the surfactant mixtures according to the invention is that they can be formulated in an anhydrous manner, i.e. with a water content of less than 2% by weight, to give finished products. In these products, because of the freedom from water even in the neutral range, stabilization to prevent build-up of germs is not necessary.

A further advantage of the surfactant mixtures according to the invention comprising alkyl and/or alkenyl oligoglycosides and fatty alcohol is that they draw in water to a lesser extent then pure alkyl and/or alkenyl oligoglycosides. For this reason, these mixtures, e.g. in the form of granules, exhibit a lower tendency toward clumping during storage.

The present invention will now be illustrated in more detail by reference to the following specific, non-limiting examples.

EXAMPLES E1–E3 AND COMPARATIVE EXAMPLES V1–V2

The table below describes alkyl and/or alkenyl oligoglycoside mixtures with various fatty alcohol contents. The Examples E1 to E3 according to the invention are compared with the Comparative Examples V1 to V2. The following are used:

$C_{12}$–$C_{14}$-alkyl polyglucoside, degree of DP=1.43

$C_{12}$–$C_{14}$-alcohol: linear $C_{12-14}$-fatty alcohol

1% hydrogen peroxide (35%) based on alkyl polyglucoside active substance

| | | E1 | E2 | E3 | V1 | V2 |
|---|---|---|---|---|---|---|
| $C_{12}$–$C_{14}$-Alcohol | [%] | 8.6 | 12.5 | 24.2 | 3 | 3 |
| Bleaching temperature | [° C.] | 120 | 110 | 105 | 130 | 148 |
| Viscosity | [mPas] | 600 | 350 | 60 | 1500 | 600 |
| Color | [Klett] | 55 | 23 | 12 | 110* | ° |

[%]: Percent by weight based on alkyl polyglucoside active substance
Color: 1% APG/fatty alcohol on isopropanol, filtered and measured using a Lico 200 colorimeter (Lange) in a 11 mm round cell.
Viscosity: Rheomat 115 rotary viscometer in accordance with DIN 145
°: Bleaching no longer possible since the bleach is destroyed.
*: Bleach cannot be mixed in due to the high viscosity.

%: Percent by weight based on alkyl polyglucoside active substance

Color: 1% APG/fatty alcohol in isopropanol, filtered and measured using a Lico 200 calorimeter (Lange) in a 11 mm round cell.

Viscosity: Rheomat 115 rotary viscometer in accordance with DIN 145

°: Bleaching no longer possible since the bleach is destroyed.

*: Bleach cannot be mixed in due to the high viscosity.

The table shows that the viscosity of the surfactant mixtures according to the invention decreases with increasing fatty alcohol content and the bleaching temperature can be correspondingly lower.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A process for preparing light-colored surfactant mixtures, said process comprising:

(a) providing an initial mixture comprising (i) at least one surfactant selected from the group consisting of alkyl oligoglycosides and alkenyl oligoglycosides, and (ii) a rheology-modifying agent; wherein the initial mixture has a viscosity of from 10 to 1000 mPas at a temperature of from 85 to 130° C., and a water content of less than 2% by weight, based on the at least one surfactant; and (b) bleaching the initial mixture comprising the at least one surfactant and the rheology-modifying agent at a temperature of from 85 to 130° C. to form a light-colored surfactant mixture having a water content of less than 2% by weight, based on the at least one surfactant.

2. The process according to claim 1, wherein the initial mixture has a water content of less than 1.5% by weight, based on the at least one surfactant; and the light-colored surfactant mixture has a water content of less than 1.5% by weight, based on the at least one surfactant.

3. The process according to claim 1, wherein the initial mixture has a water content of less than 0.5% by weight, based on the at least one surfactant; and the light-colored surfactant mixture has a water content of less than 0.5% by weight, based on the at least one surfactant.

4. The process according to claim 1, wherein the rheology-modifying agent is present in the initial mixture in an amount of from 6 to 30% by weight, based on the at least one surfactant.

5. The process according to claim 1, wherein the rheology-modifying agent is present in the initial mixture in an amount of from 8 to 25% by weight, based on the at least one surfactant.

6. The process according to claim 1, wherein the rheology-modifying agent is present in the initial mixture in an amount of from 10 to 15% by weight, based on the at least one surfactant.

7. The process according to claim 1, wherein the rheology-modifying agent comprises a component selected from the group consisting of fatty alcohols, alkoxylated alkanols, alkylene oxides and mixtures thereof.

8. The process according to claim 1, wherein the rheology-modifying agent comprises a fatty alcohol of the general formula (II):

$$R^2—OH \quad (II)$$

wherein $R^2$ represents a hydrocarbon group having 4 to 22 carbon atoms and up to 3 double bonds.

9. The process according to claim 1, wherein the rheology-modifying agent comprises a fatty alcohol of the general formula (II):

$$R^2—OH \quad (II)$$

wherein $R^2$ represents a linear hydrocarbon group having 12 to 16 carbon atoms.

10. The process according to claim 1, wherein the rheology-modifying agent comprises a fatty alcohol polyethylene glycol/polypropylene glycol ether of the general formula (III):

$$R^3O(CH_2CH_2O)_n[CH_2(CH_3)CHO]_mR^4 \quad (III)$$

wherein $R^3$ represents an alk(en)yl radical having from 8 to 22 carbon atoms, $R^4$ represents a hydrogen atom or an alkyl radical having from 1 to 8 carbon atoms, n represents a number of from 1 to 40 and m represents a number of from 0 to 10.

11. The process according to claim 1, wherein the rheology-modifying agent comprises a fatty alcohol polypropylene glycol/polyethylene glycol ether of the general formula (IV):

$$R^5O[CH_2(CH_3)CHO]_q(CH_2CH_2O)_rR^6 \quad (IV)$$

wherein $R^5$ represents an alk(en)yl radical having from 8 to 22 carbon atoms, $R^6$ represents a hydrogen atom or an alkyl radical having from 1 to 8 carbon atoms, q represents a number of from 1 to 5 and r represents a number of from 0 to 15.

12. The process according to claim 1, wherein the bleaching comprises contacting the initial mixture with a bleaching agent selected from the group consisting of aqueous hydrogen peroxide, chlorine bleaching liquors, and organic peracids.

13. The process according to claim 12, wherein the bleaching agent comprises aqueous hydrogen peroxide.

14. The process according to claim 1, wherein the at least one surfactant and the rheology-modifying agent are present in the initial mixture as a reaction product obtained by the reaction of a sugar and a fatty alcohol in the presence of a catalyst.

15. A process for preparing light-colored surfactant mixtures, said process comprising:

(a) providing an initial mixture comprising (i) at least one surfactant selected from the group consisting of alkyl oligoglycosides and alkenyl oligoglycosides, and (ii) a rheology-modifying agent selected from the group consisting of fatty alcohols, alkoxylated alkanols, alkylene oxides and mixtures thereof; wherein the initial mixture has a viscosity of from 50 to 500 mPas at a temperature of from 90 to 120° C., and a water content of less than 1.5% by weight, based on the at least one surfactant; and (b) contacting the initial mixture comprising the at least one surfactant and the rheology-modifying agent with a bleaching agent selected from the group consisting of aqueous hydrogen peroxide, chlorine bleaching liquors, and organic peracids, at a temperature of from 90 to 120° C. to form a light-colored surfactant mixture having a water content of less than 1.5% by weight, based on the at least one surfactant.

16. A process for preparing light-colored surfactant mixtures, said process comprising:

(a) providing an initial mixture comprising a reaction product obtained by the reaction of a sugar and a fatty alcohol in the presence of a catalyst to produce a technical-grade synthesis mixture of an alk(en)yl oligoglycoside and a fatty alcohol; wherein the initial mixture has a viscosity of from 50 to 500 mPas at a temperature of from 90 to 120° C., and a water content of less than 1.5% by weight, based on the at least one surfactant; and (b) contacting the initial mixture comprising the at least one surfactant and the rheology-modifying agent with a bleaching agent selected from the group consisting of aqueous hydrogen peroxide, chlorine bleaching liquors, and organic peracids, at a temperature of from 90 to 120° C. to form a light-colored surfactant mixture having a water content of less than 1.5% by weight, based on the at least one surfactant.

* * * * *